United States Patent [19]

McGinness

[11] 4,376,650

[45] Mar. 15, 1983

[54] HOT WORKABILITY OF AN AGE HARDENABLE NICKLE BASE ALLOY

[75] Inventor: Robert L. McGinness, Charlotte, N.C.

[73] Assignee: Teledyne Industries, Inc., Monroe, N.C.

[21] Appl. No.: 300,103

[22] Filed: Sep. 8, 1981

[51] Int. Cl.[3] ..... C22C 33/00; C22C 19/05

[52] U.S. Cl. ..... 75/129; 75/49; 75/82; 75/130.5; 420/443; 420/582

[58] Field of Search ..... 75/82, 49, 129, 130.5, 75/58, 171

[56] References Cited

U.S. PATENT DOCUMENTS 3,467,167 9/1969 Mahin ..... 75/49

3,607,229 9/1971 Knuppel ..... 75/49

3,695,946 10/1972 Demeaux ..... 75/49

*Primary Examiner*—P. D. Rosenberg

*Attorney, Agent, or Firm*—Bell, Seltzer, Park & Gibson

[57] ABSTRACT

Very significant improvements in the hot workability of an age hardenable nickel base alloy containing 17 to 20 percent chromium, 2.9 to 5.3 percent titanium, 1.8 to 2.8 percent aluminum, 11 to 15.5 cobalt, 2.5 to 7 percent molybdenum, 0.8 to 1.5 percent tungsten, 0.004 to 0.040 percent boron, 0.02 to 0.06 percent carbon and about 52 to about 57 percent nickel are achieved by melting the raw materials under vacuum in the presence of lime, and forming a desulfurizing lime slag on the surface of the molten raw materials, and thereafter adding magnesium thereto just prior to casting the alloy, preferably while maintaining the molten raw material under an inert gas atmosphere.

11 Claims, 1 Drawing Figure

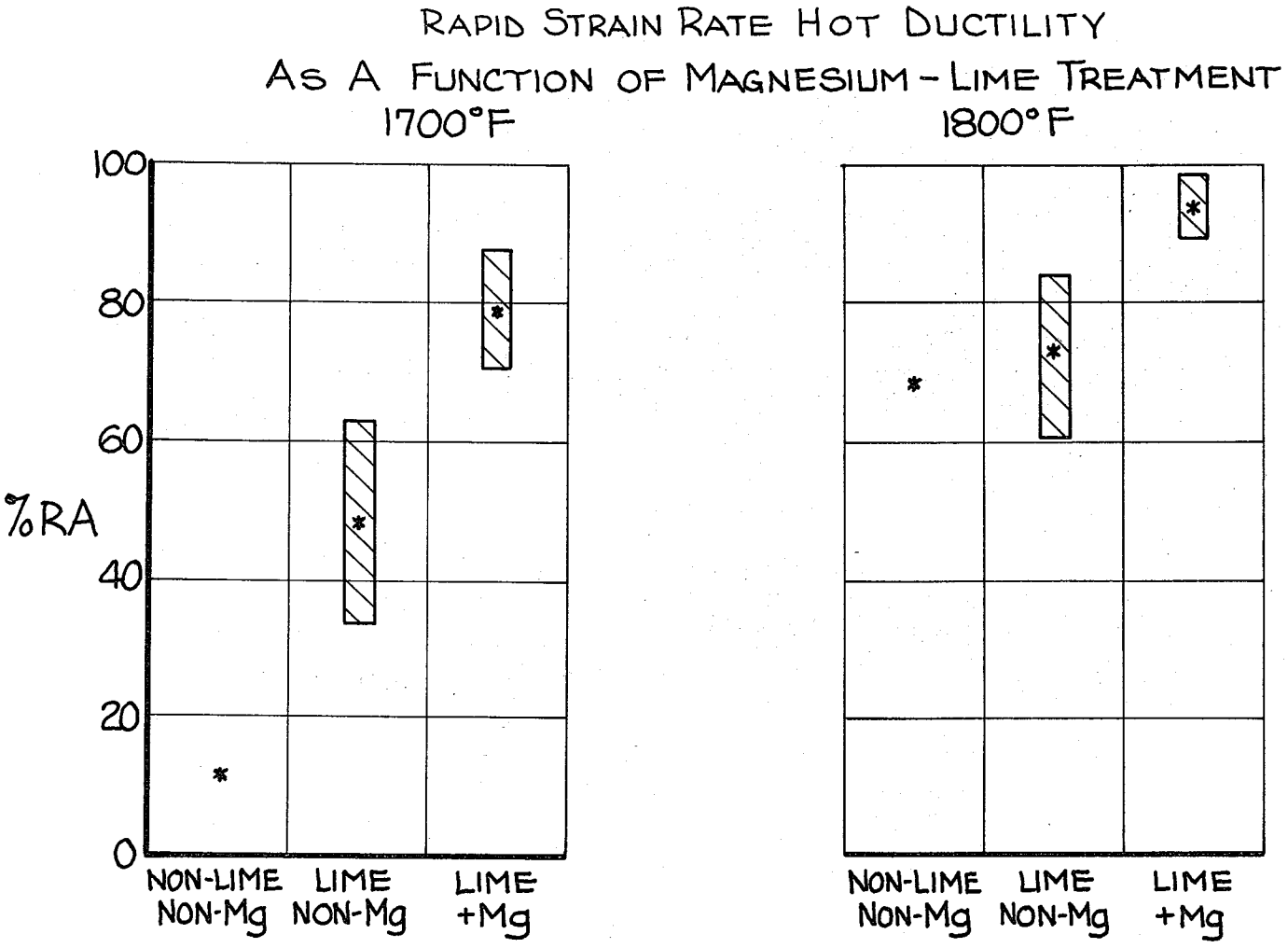
RAPID STRAIN RATE HOT DUCTILITY
AS A FUNCTION OF MAGNESIUM - LIME TREATMENT
1700°F
1800°F
% RA
100
80
60
40
20
0
NON-LIME NON-Mg
LIME NON-Mg
LIME +Mg

HOT WORKABILITY OF AN AGE HARDENABLE NICKLE BASE ALLOY

FIELD AND BACKGROUND OF THE INVENTION

This invention relates to a method for improving the hot workability of an age hardenable nickel base alloy and to an alloy having such improved hot workability properties.

In the commercial production of certain age hardenable nickel base alloys, severe difficulties have been encountered during hot rolling of the cast ingots and wrought billet, resulting in cracking along the surface. This cracking necessitates significant amounts of grinding and loss of usable alloy, thereby significantly lowering the yield. Problems with hot working have also been experienced during subsequent forging of the wrought bar into parts or shapes, resulting in cracking.

One such alloy is commercially known by the designation U-720 and has the following nominal composition: about 18 percent chromium, about 5 percent titanium, about 2.5 percent aluminum, about 14.75 percent cobalt, about 3 percent molybdenum, about 1.25 percent tungsten, about 0.035 percent boron, about 0.035 percent carbon, about 0.037 percent zirconium, up to 0.1 percent columbium, up to 0.1 percent tantalum, up to 0.1 percent vanadium, up to 0.1 percent copper, up to 0.50 percent iron, up to 0.15 percent silicon, up to 0.15 percent manganese, up to 0.1 percent phosphorus, up to 0.0025 percent silver, up to 0.01 percent sulfur, and the balance nickel.

SUMMARY OF THE INVENTION

The present invention is based upon the discovery that significant improvements in the hot workability of certain age hardenable nickel base alloys can be achieved by deliberate additions of lime and magnesium under specified conditions during melting of the alloy.

More specifically, it has been discovered in accordance with the present invention that significant improvements in the hot workability of the alloy are achieved by melting the appropriate raw materials under a vacuum in the presence of lime and forming a desulfurizing lime slag on the surface of the molten raw materials, and thereafter adding a small but significant amount of magnesium thereto just prior to casting the alloy, preferably while under an inert gas atmosphere.

This improvement is applicable to the production of the specific class of age hardenable nickel base alloys containing the following basic elements: 17 to 20 percent chromium, 2.9 to 5.3 percent titanium, 1.8 to 2.8 percent aluminum, 11 to 15.5 percent cobalt, 2.5 to 7 percent molybdenum, 0.8 to 1.5 percent tungsten, 0.004 to 0.040 percent boron, 0.02 to 0.06 percent carbon, and about 52 to about 57 percent nickel. This class of alloys may also include minor amounts of other elements and incidental impurities including, but not limited to, up to 0.05 percent zirconium, up to 0.1 percent columbium, up to 0.1 percent tantalum, up to 0.1 percent vanadium, up to 0.1 percent copper, up to 2 percent iron, up to 0.15 percent silicon, up to 0.15 percent manganese, up to 0.1 percent phosphorus, up to 0.1 sulfur and up to 0.0025 percent silver.

The improvement provided in accordance with the present invention is particularly applicable to the age hardenable nickel base alloy known commercially as U-720, the specification of which calls for a composition as follows: 17.5 to 18.5 percent chromium, 4.75 to 5.25 percent titanium, 2.25 to 2.75 percent aluminum, 14 to 15.5 percent cobalt, 2.75 to 3.25 percent molybdenum, 1 to 1.5 percent tungsten, 0.03 to 0.04 percent boron, 0.03 to 0.04 percent carbon, 0.02 to 0.05 percent zirconium, up to 0.1 percent columbium, up to 0.1 percent tantalum, up to 0.1 percent vanadium, up to 0.1 percent copper, up to 0.5 percent iron, up to 0.15 percent silicon, up to 0.15 percent manganese, up to 0.1 percent phosphorus, up to 0.0025 percent silver, up to 0.01 percent sulfur, balance essentially nickel.

The improved hot workability and other desirable characteristics achieved in accordance with the present invention are believed to be attributable, at least in part, to the critical combination of magnesium and sulfur content provided in the alloy by the combined use of lime and magnesium addition in the melting operation. Melting of the raw materials in the presence of lime, together with the addition of magnesium just prior to casting of the molten alloy, are believed to contribute to the hot workability of the alloy by removing and/or tying up sulfur present as an impurity in the raw materials. Specifically, the addition of lime to the molten raw materials is believed to result in removal of major quantities of the sulfur impurity. The subsequent addition of magnesium is believed to further contribute to the hot workability properties by tying up significant amounts of sulfur which may remain in the alloy following the lime treatment. Because of the high vapor pressure of magnesium, it is preferred, in order to obtain the desired residual levels of magnesium in the alloy, that the magnesium be added to the molten raw materials under an inert gas back pressure and that the molten materials then be promptly poured from the furnace to form ingots.

It has been observed that alloys exhibiting improvements in hot workability pursuant to the lime and magnesium practice of this invention are characterized by a magnesium content within critical limits of from 10 to 100 parts per million and a sulfur content of no more than 50 parts per million. Preferably, the lime and magnesium practice is carried out in such a manner that the magnesium content is within the range of 10 to 60 parts per million and the sulfur content no more than 30 parts per million.

Thus, in accordance with a further aspect of the present invention, there is provided an age hardenable nickel base alloy which is characterized by excellent hot workability and which consists essentially of 17 to 20 percent chromium, 2.9 to 5.3 percent titanium, 1.8 to 2.8 percent aluminum, 11 to 15.5 percent cobalt, 2.5 to 7 percent molybdenum, 0.8 to 1.5 percent tungsten, 0.004 to 0.040 percent boron, 0.02 to 0.06 percent carbon, up to 0.05 percent zirconium, up to 0.1 percent columbium, up to 0.1 percent tantalum, up to 0.1 percent vanadium, up to 0.1 percent copper, up to 2 percent iron, up to 0.15 percent silicon, up to 0.15 percent manganese, up to 0.1 percent phosphorus, up to 0.025 percent silver, no more than 50 parts per million sulfur, from 10 to 100 parts per million magnesium, and the balance essentially nickel.

The improved alloy of this invention is further characterized by having excellent hot workability, as evidenced by a rapid strain rate hot ductility significantly greater than that of similar alloys without the lime and magnesium practice. Hot workable alloys in accordance with this invention exhibit a rapid strain rate hot ductility at 1700° F. greater than 50 percent RA, and generally 60 percent RA or greater.

The use of lime in the melting of nickel base alloys has been practiced heretofore. Also, it has been recognized in the prior art that magnesium can contribute to hot workability of certain alloys. However, insofar as applicant is aware, nothing in the prior art has taught or suggested the use of lime in combination with magnesium addition as described herein. Further, nowhere does the prior art recognize or suggest that for the particular narrow class of alloys to which the present invention pertains the magnesium content must be maintained within critical narrow limits of from 10 to 100 parts per million and the sulfur content at no more than 50 parts per million, and most desirably from 10 to 60 parts per million magnesium and no more than 30 parts per million sulfur.

ILLUSTRATIVE EXAMPLE

The following example is presented in order to give those skilled in the art a better understanding of the invention, but is not intended to be understood as limiting the invention.

Heats of U-720 alloy having a nominal composition of about 18 percent chromium, about 5 percent titanium, about 2.5 percent aluminum, about 14.75 percent cobalt, about 3 percent molybdenum, about 1.25 percent tungsten, about 0.035 percent boron, about 0.037 percent zirconium, about 0.035 percent carbon, and the balance essentially nickel were prepared by vacuum melting in a vacuum induction furnace. In the first heat, no special additions or special melting practices were employed. Results of this effort were very poor, in that severe hot workability problems were encountered in rolling and subsequent forging.

In the next series of heats, in an effort to improve the hot workability of the alloy, about 0.5 percent dry lime was added to the vacuum melting furnace with the base charge of raw materials, producing a lime desulfurizing slag on the surface of the molten alloy. An improvement in hot workability was noted in the form of reduced cracking during hot rolling and increased forgeability during forging operations. However wide differences in workability were noted in different heats.

In the final series of heats, up to about 0.08 percent by weight magnesium was added to the lime desulfurized heat under inert gas back pressure at the end of the refine cycle, just prior to pouring from the vacuum furnace. A very significant improvement in hot workability was observed.

The magnesium and sulfur analyses of the thus produced heats are set forth in Table I below.

TABLE I

LIME AND SULFUR ANALYSIS OF VARIOUS U-720 ALLOYS

| | No Lime No Mg | Lime No Mg | Lime Mg |
|---|---|---|---|
| Number of samples | 1 | 11 | 75 |

TABLE I-continued

LIME AND SULFUR ANALYSIS OF VARIOUS U-720 ALLOYS

| | No Lime No Mg | Lime No Mg | Lime Mg |
|---|---|---|---|
| ppm Mg (mean) | 5 | 7.1 | 23.2 |
| Std. dev. | — | 7.57 | 7.7 |
| Number of samples | 1 | 66 | 85 |
| ppm S (mean) | 17 | 14.5 | 18.8 |

The hot workability of the above-noted alloys was quantitatively measured by rapid strain rate hot tensile testing. In this test, the specimens are first annealed at 2000° F. for one hour and air cooled. Tensile specimens, machined from the material being studied, are heated to a series of test temperatures approximating the range normally employed in hot working. The specimens are broken in tension, at a strain rate of approximately 0.05 inches per second. The hot ductility is expressed as the percentage of reduction of area (%RA) of the broken bars, and this has been found to be a good indication of hot workability and to correlate well with actual results in hot rolling. With this alloy, it was noted that differences observed in hot workability correlated well with hot ductility at 1700° and 1800° F. These temperatures span the range of normal finishing temperatures experienced in hot rolling of this alloy.

The mean and standard deviation of the rapid strain rate hot ductility tests were calculated, and are set forth in Table II below.

TABLE II

RAPID STRAIN RATE HOT DUCTILITY OF VARIOUS U-720 ALLOYS

| | No Lime No Mg | | Lime No Mg | | Lime Mg | |
|---|---|---|---|---|---|---|
| Temperature | 1700° F. | 1800° F. | 1700° F. | 1800° F. | 1700° F. | 1800° F. |
| Number of Samples | 1 | 1 | 14 | 14 | 12 | 12 |
| % RA (mean) | 12 | 68 | 48.5 | 72.6 | 77.8 | 94.2 |
| Std. dev. | — | — | 14.3 | 11.4 | 8.5 | 4 |

Rapid strain rate hot ductility results from the above tests are displayed graphically in the figure. The asterisk (*) represents the mean value of %RA and the shaded bar area indicates the range or spread of %RA, based on the standard deviation. A significant improvement in %RA is apparent in the lime plus Mg practice of the present invention as compared to the nonlime/non-Mg practice and the lime/non-Mg practice. The hot ductility of the lime plus Mg heats is actually better at 1700° F. than the non-Mg heats are at 1800° F., a 100° F. or greater improvement which is of tremendous significance in hot working. Much more consistent results are also displayed by the lime plus Mg heats, especially at 1700° F., as is evident from the much narrower spread in the %RA as compared to the lime/non-Mg practice. It will be seen that the hot workability of alloys in accordance with the invention is evidenced by a %RA at 1700° and 1800° F. consistently greater than 50 percent, and more specifically, greater than 60 percent at 1700° F. and greater than 80 percent at 1800° F.

Another measure of the improvement in hot workability observed for the lime plus Mg composition is yield. This is a measure of the amount of final bar product shipped expressed as a percentage of the amount of the starting material. Yield figures accumulated on lime plus Mg heats show a 34 percent increase over lime/non-Mg heats.

Still another improvement noted for the lime plus Mg composition over the lime/non-Mg composition was a dramatic reduction in the frequency of sonic indications found in finish centerless ground bar product. Lime plus Mg heats average slightly less than one (1) sonic defect per ingot while lime/non-Mg heats had more than four (4) sonic defects per ingot.

In the drawings and specification, there has been set forth a preferred embodiment of the invention, and although specific terms are employed, they are used in a generic and descriptive sense only and not for purposes of limitation.

That which is claimed is:

1. In a method for producing an age hardenable nickel base alloy containing 17 to 20 percent chromium, 2.9 to 5.3 percent titanium, 1.8 to 2.8 percent aluminum, 11 to 15.5 percent cobalt, 2.5 to 7 percent molybdenum, 0.8 to 1.5 percent tungsten, 0.004 to 0.040 percent boron, 0.02 to 0.06 percent carbon, and about 52 to about 57 percent nickel, and in which appropriate raw materials for producing an alloy of said composition are melted, refined, and thereafter cast into an ingot, the improvement which comprises improving the hot workability of the alloy by melting said appropriate raw materials under a vacuum in the presence of lime and forming a desulfurizing lime slag on the surface of the molten raw materials, and thereafter adding magnesium thereto just prior to casting.

2. A method as set forth in claim 1 wherein said step of adding magnesium just prior to casting is carried out in such a manner as to obtain in the cast alloy a magnesium content of from 10 to 100 parts per million and a sulfur content of no more than 50 parts per million.

3. A method as set forth in claim 1 wherein said step of adding magnesium just prior to casting is carried out in such a manner as to obtain in the cast alloy a magnesium content of from 10 to 60 parts per million and a sulfur content of no more than 30 parts per million.

4. A method as set forth in any one of claims 1, 2 or 3 wherein said step of adding magnesium just prior to casting is carried out while under an inert gas atmosphere.

5. In a method for producing an age hardenable nickel base alloy containing 17.5 to 18.5 percent chromium, 4.75 to 5.25 percent titanium, 2.25 to 2.75 percent aluminum, 14 to 15.5 percent cobalt, 2.75 to 3.25 percent molybdenum, 1 to 1.5 percent tungsten, 0.03 to 0.04 percent boron, 0.03 to 0.04 percent carbon, 0.02 to 0.05 percent zirconium, up to 0.1 percent columbium, up to 0.1 percent tantalum, up to 0.1 percent vanadium, up to 0.1 percent copper, up to 0.5 percent iron, up to 0.15 percent silicon, up to 0.15 percent manganese, up to 0.1 percent phosphorus, up to 0.0025 percent silver, up to 0.01 percent sulfur and the balance essentially nickel except for incidental impurities, and in which appropriate raw materials for producing an alloy of said composition are melted, refined, and thereafter cast into an ingot, the improvement which comprises improving the hot workability of the alloy by melting said appropriate raw materials under a vacuum in the presence of lime and forming a desulfurizing lime slag on the surface of the molten raw materials, and thereafter maintaining the molten raw materials under an inert gas atmosphere while adding magnesium thereto just prior to casting so as to obtain in the cast alloy a magnesium content of 10 to 100 parts per million and a sulfur content of no more than 50 parts per million.

6. An age hardenable nickel base alloy characterized by having excellent hot workability and consisting essentially of 17 to 20 percent chromium, 2.9 to 5.3 percent titanium, 1.8 to 2.8 percent aluminum, 11 to 15.5 percent cobalt, 2.5 to 7 percent molybdenum, 0.8 to 1.5 percent tungsten, 0.004 to 0.040 percent boron, 0.02 to 0.06 percent carbon, up to 0.05 percent zirconium, up to 0.1 percent columbium, up to 0.1 percent tantalum, up to 0.1 percent vanadium, up to 0.1 percent copper, up to 2 percent iron, up to 0.15 percent silicon, up to 0.15 percent manganese, up to 0.1 percent phosphorus, up to 0.0025 percent silver, no more than 50 parts per million sulfur, from 10 to 100 parts per million magnesium, and the balance essentially nickel.

7. An age hardenable hot workable nickel base alloy characterized by having excellent hot workability and consisting essentially of 17.5 to 18.5 percent chromium, 4.75 to 5.25 percent titanium, 2.25 to 2.75 percent aluminum, about 14 to 15.5 percent cobalt, 2.75 to 3.25 percent molybdenum, 1 to 1.5 percent tungsten, 0.03 to 0.04 percent boron, 0.03 to 0.04 percent carbon, 0.02 to 0.05 percent zirconium, up to 0.1 percent columbium, up to 0.1 percent tantalum, up to 0.1 percent vanadium, up to 0.1 percent copper, up to 0.5 percent iron, up to 0.15 percent silicon, up to 0.15 percent manganese, up to 0.1 percent phosphorus, up to 0.0025 percent silver, no more than 50 parts per million sulfur, from 10 to 100 parts per million magnesium, and the balance essentially nickel.

8. An alloy according to claim 6 or 7 including no more than 30 parts per million sulfur and 10 to 60 parts per million magnesium.

9. An age hardenable nickel base alloy according to claim 6 or 7 wherein said alloy has a rapid strain rate hot ductility at 1700° F. of greater than 50 percent RA.

10. An age hardenable nickel base alloy according to claim 6 or 7 wherein said alloy has a rapid strain rate hot ductility at 1700° F. of greater than 60 percent RA.

11. An age hardenable nickel base alloy according to claim 6 or 7 wherein said alloy has a rapid strain rate hot ductility at 1800° F. of greater than 80 percent RA.

* * * * *